US009093759B2

(12) United States Patent
Takayama et al.

(10) Patent No.: US 9,093,759 B2
(45) Date of Patent: Jul. 28, 2015

(54) CONNECTION STRUCTURE FOR ELECTRIC WIRE AND TERMINAL

(71) Applicant: YAZAKI CORPORATION, Tokyo (JP)

(72) Inventors: Tsutomu Takayama, Shizuoka (JP); Takahito Nakashima, Aichi (JP); Hiroshi Kobayashi, Aichi (JP); Saori Muramatsu, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/011,272

(22) Filed: Aug. 27, 2013

(65) Prior Publication Data

US 2013/0344752 A1 Dec. 26, 2013

Related U.S. Application Data

(63) Continuation of application No. PCT/JP2012/058256, filed on Mar. 28, 2012.

(30) Foreign Application Priority Data

Mar. 31, 2011 (JP) ..... 2011-077247

(51) Int. Cl.
*H01R 4/10* (2006.01)
*H01R 4/18* (2006.01)
(Continued)

(52) U.S. Cl.
CPC ..... *H01R 4/185* (2013.01); *H01R 4/70* (2013.01); *H01R 4/184* (2013.01); *H01R 4/62* (2013.01); *H01R 2201/26* (2013.01)

(58) Field of Classification Search
USPC ..... 439/877, 879.932, 604
See application file for complete search history.

(56) References Cited

U.S. PATENT DOCUMENTS 3,708,611 A * 1/1973 Dinger ..... 174/84 C
7,422,480 B1 * 9/2008 Musick et al. ..... 439/585
(Continued)

FOREIGN PATENT DOCUMENTS

JP 2003-203685 A 7/2003
JP 2006-269150 A 10/2006
(Continued)

OTHER PUBLICATIONS

International Search Report and Written Opinion of the International Search Report for PCT/JP2012/058256 dated Jun. 26, 2012.
(Continued)

*Primary Examiner* — Tho D Ta
(74) *Attorney, Agent, or Firm* — Kenealy Vaidya LLP

(57) ABSTRACT

A connection structure has an electric wire and a terminal. The terminal includes a mating terminal connection portion to be connected to a mating terminal and a crimping portion which crimps to a conductor of an electric wire. The electric wire is connected to the terminal by the crimping portion. The connection structure includes an intermediate portion that is provided between the mating terminal connection portion and the crimping portion and has a housing portion which houses an end portion of the conductor, an intermediate portion sealing member that is fitted in the housing portion, and a hollow covering member that extends in an extending direction of the electric wire and covers a portion from the intermediate portion to an insulating covering region.

15 Claims, 11 Drawing Sheets

(51) Int. Cl.
*H01R 4/70* (2006.01)
*H01R 4/62* (2006.01)

(56) References Cited

U.S. PATENT DOCUMENTS

| | | | |
|---|---|---|---|
| 2006/0205289 | A1 | 9/2006 | Kumakura |
| 2008/0139056 | A1 | 6/2008 | Kumakura |
| 2013/0126234 | A1 | 5/2013 | Ono et al. |

FOREIGN PATENT DOCUMENTS

| | | | |
|---|---|---|---|
| JP | 2008-176970 | A | 7/2008 |
| JP | 2008-293810 | A | 12/2008 |
| JP | 2009-230998 | A | 10/2009 |
| JP | 2009-301891 | A | 12/2009 |
| JP | 2010-49941 | A | 3/2010 |
| JP | 3159035 | U | 5/2010 |
| JP | 2010-165630 | A | 7/2010 |
| JP | 2012-43584 | A | 3/2012 |
| JP | 2012-054217 | A | 3/2012 |
| JP | 2012-059519 | A | 3/2012 |
| JP | 2012-059520 | A | 3/2012 |
| JP | 2012-169121 | A | 9/2012 |
| JP | 2012-169123 | A | 9/2012 |
| JP | 2012-169124 | A | 9/2012 |
| JP | 2012-185984 | A | 9/2012 |
| WO | 2012-043049 | A1 | 4/2012 |

OTHER PUBLICATIONS

International Preliminary Report on Patentability for PCT Patent App. No. PCT/JP2012/058256 (Oct. 2, 2013).
Korean Office Action for the related Korean Patent Application No. 10-2013-7023039 dated Nov. 27, 2014.
Japanese Office Action for the related Japanese Patent Application No. 2011-077247 dated Feb. 10, 2015.
Chinese Office Action for the related Chinese Patent Application No. 201280011194.4 dated Mar. 2, 2015.
Japanese Office Action for the related Japanese Patent Application No. 2011-077247 dated Nov. 25, 2014.
Notice of Decision for the related Korean Patent Application No. 10-2013-7023039 dated Apr. 21, 2015.

* cited by examiner

CONNECTION STRUCTURE FOR ELECTRIC WIRE AND TERMINAL

CROSS REFERENCE TO RELATED APPLICATIONS

This application is a continuation of PCT application No. PCT/JP2012/058256, which was filed on Mar. 28, 2012 based on Japanese Patent Application (No. 2011-077247) filed on Mar. 31, 2011, the contents of which are incorporated herein by reference.

BACKGROUND

1. Field of the Invention

The present invention relates to a connection structure for an electric wire and a terminal.

2. Description of the Related Art

Conventionally, signal lines and power lines in which an electric wire having a conductor made of a copper material and a terminal made of a copper material are connected to each other have been used in automobiles, consumer electronics products, etc.

On the other hand, in the automobile industry, to reduce influences on the environment, it is an important matter to increase the fuel efficiency by reducing the weight of vehicles. To this end, electric wires which employ, as a material of the conductor, aluminum which is lighter than copper are attracting much attention.

However, such electric wires are associated with a problem that aluminum is prone to corrosion under the presence of water and copper ions and hence they tend to corrode if water enters the connection portion of the aluminum conductor and the copper terminal.

In view of the above, a connection structure for an electric wire and a terminal has been proposed which prevents corrosion by preventing entrance of water by covering a connection portion of an aluminum conductor and a copper terminal with a heat-shrinkable tube (Refer to JP-A-2010-165630).

In the connection structure for the electric wire and the terminal disclosed in JP-A-2010-165630, an electric wire having a conductor covered with a covering member is connected to a connector terminal having an intermediate connection portion between a contact portion and a wire barrel portion. The connection structure for the electric wire and the terminal has a conductor connection portion in which the conductor is fastened to the wire barrel portion. The conductor connection portion is covered with a waterproof tube which is a heat-shrinkable tube. The intermediate connection portion and its neighborhood are covered with a terminal-side end portion of the waterproof tube without interstices.

However, there are a wide variety of terminal shapes. There may be terminals each of which is shaped so as to be difficult to cover with a hollow covering member such as a heat-shrinkable tube so that it is in close contact with the outer surfaces of the terminal. With such terminals, the waterproof performance may become low.

SUMMARY

The present invention has been made in the above circumstances, and an object of the invention is to provide a connection structure for the electric wire and the terminal which can prevent entrance of water more reliably and can also prevent corrosion even in the case of using a hollow covering member.

The invention solves the above-described problems by the following configurations:

(1) A connection structure for an electric wire and a terminal which has a mating terminal connection portion to be connected to a mating terminal, a terminal having a crimping portion which is crimped onto a conductor of an electric wire, and the electric wire in which an insulating covering member is removed in an end portion and the conductor is thereby exposed to the outside there, and in which the electric wire is connected to the terminal by the crimping portion, comprising an intermediate portion which is provided between the mating terminal connection portion and the crimping portion and has a housing portion which houses an end portion, exposed to the outside, of the conductor; an intermediate portion sealing member which is fitted in the housing portion; and a hollow covering member which extends in an extending direction of the electric wire and covers portions from the intermediate portion to an insulating covering region in which the electric wire is covered with the insulating covering member.

(2) The connection structure for the electric wire and the terminal according to the configuration of item (1), wherein the intermediate portion sealing member is molded integrally with the terminal.

(3) The connection structure for the electric wire and the terminal according to the configuration of item (2), wherein the housing portion has a bottom wall, a pair of side walls which are erected from both edges of the bottom wall, and a projection which projects from a top end of one of the pair of side walls; and the intermediate portion sealing member is molded integrally with the terminal in a state that the projection is bent into the housing portion.

(4) The connection structure for the electric wire and the terminal according to the configuration of any one of items (1) to (3), wherein the intermediate portion sealing member has a positioning portion for the hollow covering member, the positioning portion being an end portion, opposed to the mating terminal connection portion, of the intermediate portion sealing member, projecting in a flange-like manner so as to conform to an outer periphery, located at a position of the end portion, of the terminal, and being formed integrally with the terminal.

(5) The connection structure for the electric wire and the terminal according to the configuration of item (1), wherein the intermediate portion sealing member has a sealing-member-side engagement portion; the intermediate portion of the terminal has a terminal-side engagement portion; and the intermediate portion sealing member is fixed in the housing portion as a result of engagement between the sealing-member-side engagement portion and the terminal-side engagement portion.

(6) The connection structure for the electric wire and the terminal according to the configuration of any one of items (1), (2), (4) and (5), wherein the housing portion has a bottom wall, a pair of side walls which are erected from both edges of the bottom wall, and a projection which projects from a top end of one of the pair of side walls; and the projection is crimped onto the intermediate portion sealing member.

(7) The connection structure for the electric wire and the terminal according to the configuration of any one of items (1)-(6), wherein the terminal has a wire support portion which is part of a bottom portion, extending from an end portion of the crimping portion to somewhere in the insulating covering region, of the crimping portion.

The connection structure for the electric wire and the terminal having the configuration of item (1) comprises the intermediate portion which is provided between the mating terminal connection portion and the crimping portion and has the housing portion which houses the end portion, exposed to the outside, of the conductor; the intermediate portion sealing member which is fitted in the housing portion; and the hollow covering member which extends in the extending direction of the electric wire and covers portions from the intermediate portion to the insulating covering region in which the electric wire is covered with the insulating covering member. As a result, the outside shapes of the portions covered with the hollow covering member are simplified by the intermediate portion sealing member, whereby the hollow covering member is more easily brought into close contact with the surfaces of the terminal. This makes it possible to prevent entrance of water more reliably and to also prevent corrosion even in the case of using a hollow covering member.

In the connection structure for the electric wire and the terminal having the configuration of item (2), the intermediate portion sealing member is molded integrally with the terminal. Therefore, the intermediate portion sealing member can be fixed reliably at a prescribed position in the housing portion.

In the connection structure for the electric wire and the terminal having the configuration of item (3), the housing portion has the bottom wall, the pair of side walls which are erected from both edges of the bottom wall, and the projection which projects from the top end of one of the pair of side walls; and the intermediate portion sealing member is molded integrally with the terminal in a state that the projection is bent into the housing portion. Therefore, the intermediate portion sealing member can be fixed more strongly at a prescribed position in the housing portion.

In the connection structure for the electric wire and the terminal having the configuration of item (4), the intermediate portion sealing member has the positioning portion for the hollow covering member, the positioning portion being the end portion, opposed to the mating terminal connection portion, of the intermediate portion sealing member, projecting in a flange-like manner so as to conform to the outer periphery, located at the position of the end portion, of the terminal, and being formed integrally with the terminal. Therefore, when the hollow covering member is attached to the terminal, the position where one end of the hollow covering member comes into contact with the positioning portion for the hollow covering member is used as a reference position of attachment of the hollow covering member. As a result, the hollow covering member can be disposed accurately at a prescribed position, whereby the waterproof performance can be enhanced.

In the connection structure for the electric wire and the terminal having the configuration of item (5), the intermediate portion sealing member is fixed in the housing portion as a result of engagement between the sealing-member-side engagement portion and the terminal-side engagement portion. Therefore, the intermediate portion sealing member can be fixed reliably at a prescribed position in the housing portion.

In the connection structure for the electric wire and the terminal having the configuration of items (6), the housing portion has the bottom wall, the pair of side walls which are erected from both edges of the bottom wall, and the projection which projects from the top end of one of the pair of side walls; and the projection is crimped onto the intermediate portion sealing member. Therefore, the intermediate portion sealing member can be fixed more strongly at a prescribed position in the housing portion.

In the connection structure for the electric wire and the terminal having the configuration of item (7), the terminal has the wire support portion which is part of the bottom portion, extending from the end portion of the crimping portion to somewhere in the insulating covering region, of the crimping portion. Since the wire support portion supports, together with the hollow covering member, that portion of the conductor which exists in a boundary region located between a conductor-exposed region and the insulating covering region, the conductor can be prevented more effectively from being damaged through bending in the boundary region.

DETAILED DESCRIPTION OF EXEMPLARY EMBODIMENTS

Connection structures for the electric wire and the terminal according to preferred embodiments of the present invention will be hereinafter described in detail with reference to the drawings.

(Embodiment 1)

Figure 1:
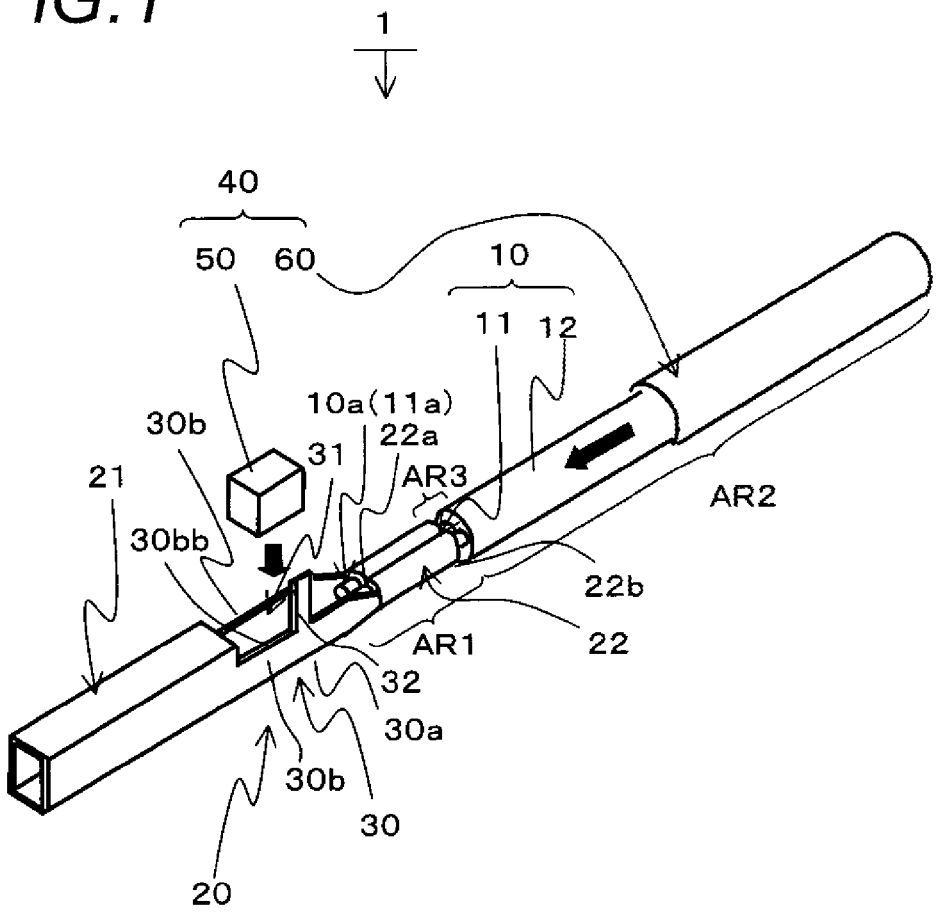
FIG. 1 is an exploded perspective view of a connection structure for an electric wire and a terminal according to a first embodiment of the present invention.
Figure 2:
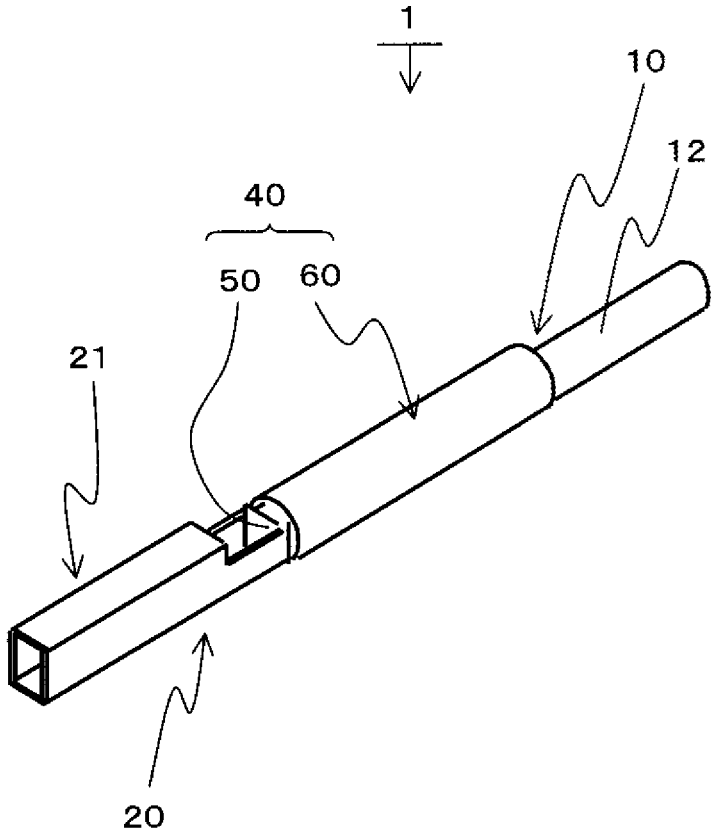
FIG. 2 is a perspective view of the connection structure for the electric wire and the terminal according to the first embodiment of the invention in an assembled state.
Figure 3:
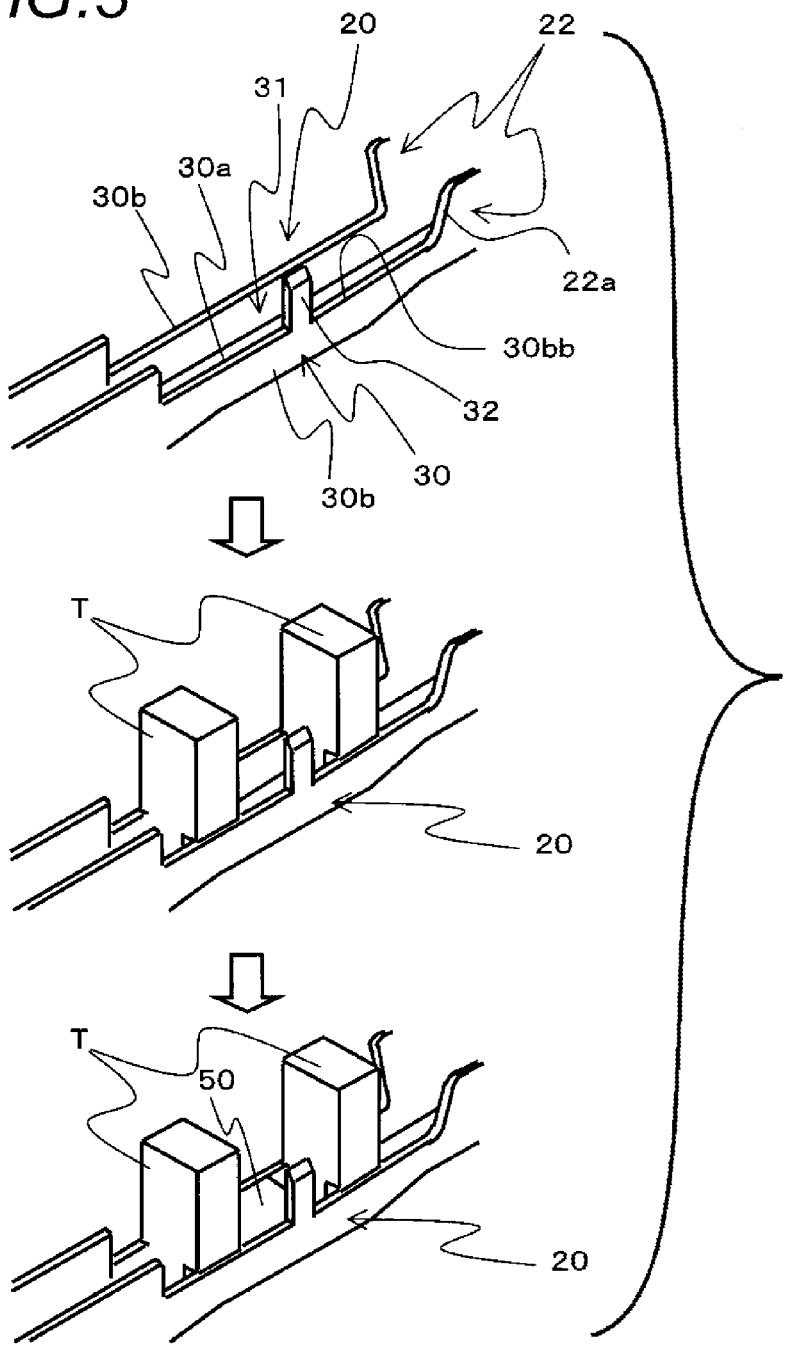
FIG. 3 is enlarged view of an essential part illustrating an example procedure according to which an intermediate portion sealing member shown in FIG. 1 is molded integrally with the terminal.

FIG. 1 is an exploded perspective view of a connection structure for electric wire and terminal 1 according to a first embodiment of the invention. FIG. 2 is a perspective view of the connection structure for electric wire and terminal 1 according to the first embodiment of the invention in an assembled state. FIG. 3 is enlarged view of an essential part illustrating an example procedure according to which an intermediate portion sealing member shown in FIG. 1 is molded integrally with a terminal 20.

The connection structure for electric wire and terminal 1 according to the first embodiment of the invention has an electric wire 10, the terminal 20, and waterproof sealing members 40. In the connection structure for electric wire and terminal 1, a conductor 11 of the electric wire 10 and the terminal 20 are connected to each other and the conductor 11 is covered with the waterproof sealing members 40 so as not to be exposed to the outside.

First, the electric wire 10 will be described.

For example, the electric wire 10 has the conductor 11 which is formed by twisting together plural core wires which are conductors made of aluminum, for example, and an insulating covering member 12 which covers the conductor 11 and is made of an insulative material such as polypropylene. The electric wire 10 has a conductor-exposed region AR1 where an end portion, on the terminal 20 connection side, of the insulating covering member 12 is removed and the conductor 11 is thereby exposed and an insulating covering region AR2 where the conductor 11 is covered with the insulating covering member 12.

Next, the terminal 20 will be described.

For example, the terminal 20 is formed by pressing a plate-like member made of a conductor such as copper. The terminal 20 has a mating terminal connection portion 21, a crimping portion 22, and intermediate portion 30.

The mating terminal connection portion 21 is a portion which is shaped like a rectangular cylinder and into which a mating terminal is to be inserted to a prescribed position in the cylinder to establish connection to the terminal 20.

The crimping portion 22 is a crimping barrel which is crimped to that portion of the conductor 11 which is in the conductor-exposed region AR1. The electric wire 10 and the terminal 20 are connected to each other by the crimping portion 22. The conductor 11 is prone to be exposed to the outside in regions in the vicinities of the crimping portion 22 which are in the conductor-exposed region AR1.

The intermediate portion 30 is a portion which is located between the mating terminal connection portion 21 and the crimping portion 22 and connects them.

The intermediate portion 30 has a concave shape in a cross-section taken perpendicularly to the extending direction of the electric wire 10 which is held by the terminal 20. The intermediate portion 30 has a bottom wall 30*a* which corresponds to the bottom of the convex shape and a pair of side walls 30*b* which are erected upward from the both edges of the bottom wall 30*a*. Therefore, an end portion 11*a*, onto which the crimping portion 22 is crimped, of the conductor 11 is disposed in a housing portion 31 which consists of the bottom wall 30*a* and the pair of side walls 30*b*.

The intermediate portion 30 has a projection 32 which projects from a top end 30*bb* of one of the pair of side walls 30*b*.

The projection 32 is crimped onto an intermediate portion sealing member (described later) which is disposed in the intermediate portion 30 and thereby causes the intermediate portion sealing member to be held at a prescribed position in the intermediate portion 30.

Next, waterproof sealing members 40 will be described.

The waterproof sealing members 40 have the intermediate portion sealing member 50 and a hollow covering member 60.

The intermediate portion sealing member 50 is shaped so as to conform to the shape of the internal housing space of the housing portion 31. More specifically, the intermediate portion sealing member 50 is approximately shaped like a rectangular parallelepiped so as to be housed in the housing portion 31 with almost no interstices. That is, the intermediate portion sealing member 50 is fitted in the housing portion 31.

The intermediate portion sealing member 50 is made of an elastic material such as a resin or a rubber. For example, as shown in FIG. 3, the intermediate portion sealing member 50 is formed integrally with the terminal 20 by performing what is called hoop molding with die face fitting pieces T set in the housing portion 31.

The hollow covering member 60 is a shrinkable tube and covers the portions from the intermediate portion 30 to the insulating covering region AR2. Therefore, the hollow covering member 60 not only has a function of preventing entrance of water into the portions from the intermediate portion 30 to the insulating covering region AR2 but also prevents the conductor 11 from being damaged through bending at the boundary between the conductor-exposed region AR1 and the insulating covering region AR2.

An intermediate-portion-30-side end portion of the hollow covering member 60 is in close contact with the terminal 20 so as to cover the outer surfaces of the intermediate portion 30 and the surface of the intermediate portion sealing member 50. Therefore, the hollow covering member 60 is not required to be in close contact with the inner surfaces of the housing portion 31.

The connection structure for electric wire and terminal 1 according to the first embodiment of the invention has the intermediate portion 30 which is provided between the mating terminal connection portion 21 and the crimping portion 22 and has the housing portion 31 which houses the end portion 11*a*, exposed to the outside, of the conductor 11; the intermediate portion sealing member 50 which is fitted in the housing portion 31; and the hollow covering member 60 which extends in the extending direction of the electric wire 10 and covers the portions from the intermediate portion 30 to the insulating covering region AR2 in which the electric wire 10 is covered with the insulating covering member 12. As a result, the outside shapes of the portions covered with the hollow covering member 60 are simplified by the intermediate portion sealing member 50, whereby the hollow covering member 60 is more easily brought into close contact with the surfaces of the terminal. This makes it possible to prevent entrance of water more reliably and to also prevent corrosion even in the case of using a hollow covering member.

In the connection structure for electric wire and terminal 1 according to the first embodiment of the invention, since the intermediate portion sealing member 50 is molded integrally with the terminal 20, the intermediate portion sealing member 50 can be fixed reliably at a prescribed position in the housing portion 31.

In the connection structure for electric wire and terminal 1 according to the first embodiment of the invention, since the projection 32 is crimped onto the intermediate portion sealing member 50 when the latter is located at a prescribed position in the housing portion 31, the intermediate portion sealing member 50 can be fixed more strongly at the prescribed position in the housing portion 31.

(Modification)

Figure 4:
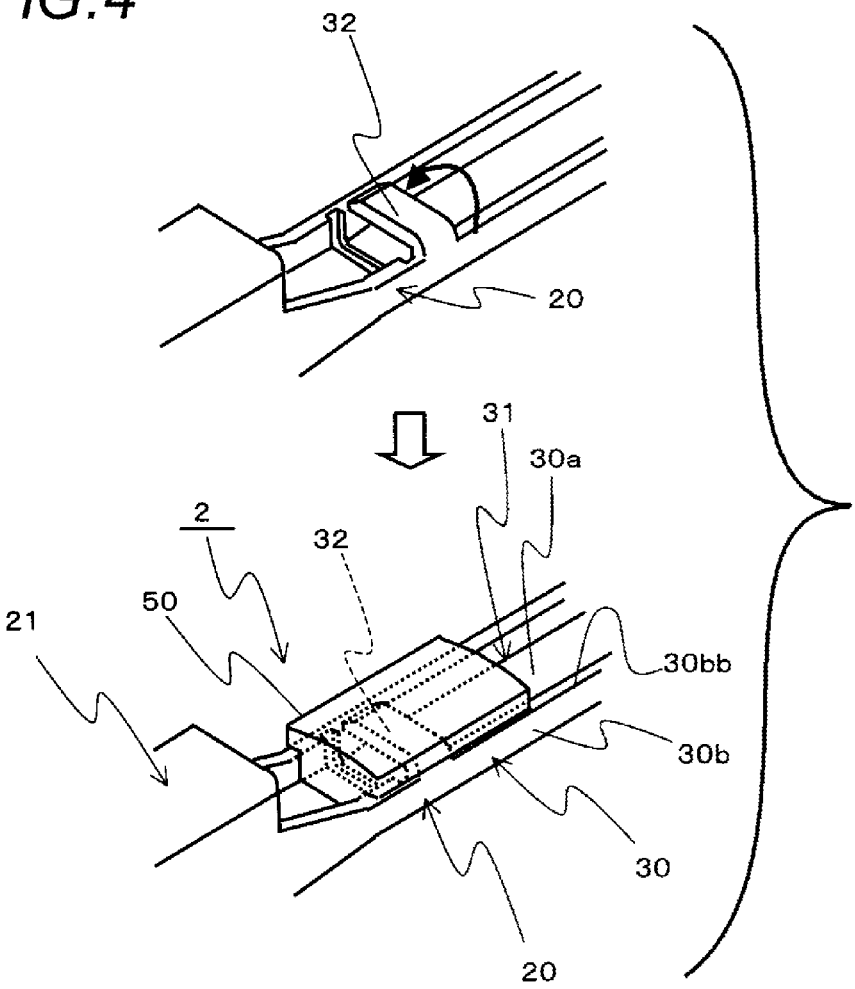
FIG. 4 is an enlarged perspective view of an essential part showing a modification of the connection structure for the electric wire and the terminal according to the first embodiment of the invention.

Now, a modification of the connection structure for electric wire and terminal 1 according to the first embodiment of the invention will be described with reference to FIG. 4. FIG. 4 shows the modification of the connection structure for electric wire and terminal 1 according to the first embodiment of the invention.

In the connection structure for electric wire and terminal 1 according to the first embodiment of the invention, the projection 32 is crimped onto the intermediate portion sealing member 50 after the intermediate portion sealing member 50 was molded integrally with the terminal 20. In contrast, in the connection structure for electric wire and terminal 2 according to this modification, an intermediate portion sealing member 50 is molded integrally with the terminal 20 (see FIG. 4(*b*)) after the projection 32 was bent into the housing portion 31 (see FIG. 4(*a*)). The other constituent elements are the same as in the above-described first embodiment and are given the same reference symbols as in the first embodiment.

In the connection structure for electric wire and terminal 2 according to the modification, since the intermediate portion sealing member 50 is formed integrally with the bent projection 32, the intermediate portion sealing member 50 can be fixed more strongly at a prescribed position in the housing portion 31.

As such, the connection structure for electric wire and terminal 2 according to the modification provides the same advantages as the connection structure for electric wire and terminal 1 according to the first embodiment.

(Embodiment 2)

Figure 5:
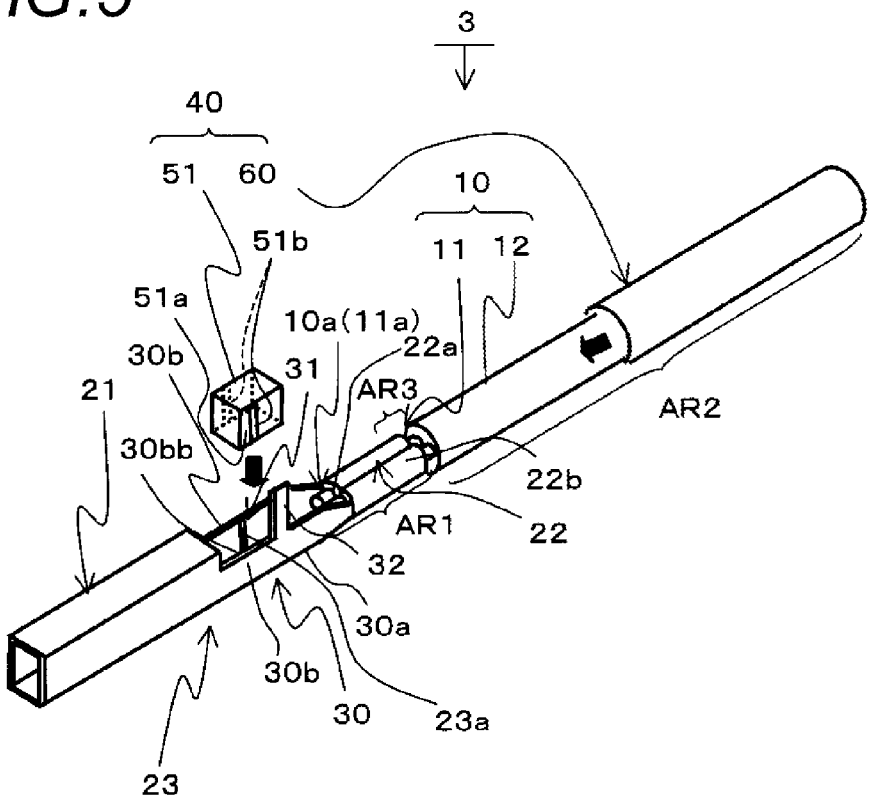
FIG. 5 is an exploded perspective view of a connection structure for the electric wire and the terminal according to a second embodiment of the invention.

Now, a connection structure for electric wire and terminal 3 according to a second embodiment of the invention will be described with reference to FIGS. 5 and 6. FIG. 5 is an exploded perspective view of the connection structure for electric wire and terminal 3 according to the second embodiment of the invention.

Figure 6:
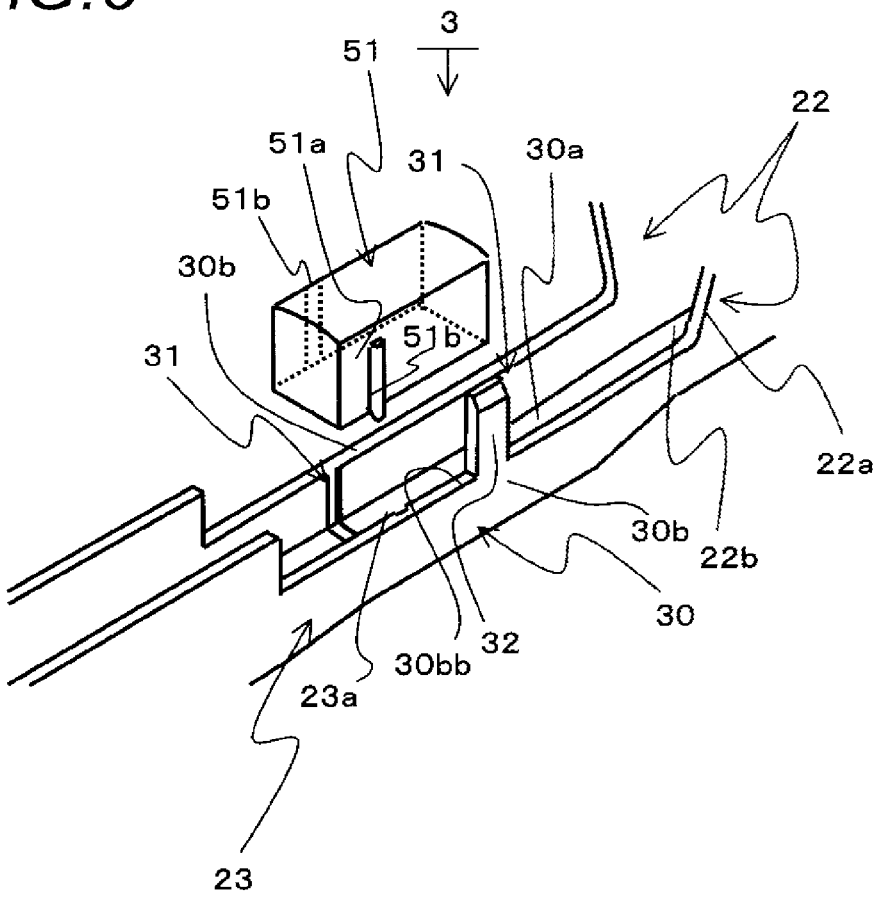
FIG. 6 is an enlarged view of an essential part of the connection structure for the electric wire and the terminal shown in FIG. 5.

FIG. 6 is an enlarged view of an essential part of the connection structure for electric wire and terminal 3 shown in FIG. 5.

The connection structure for electric wire and terminal 3 according to the second embodiment has an intermediate portion sealing member 51 and a terminal 23 in place of the intermediate portion sealing member 50 and the terminal 20, respectively.

The intermediate portion sealing member 51 is different from the intermediate portion sealing member 50 in having sealing-member-side engagement portions 51*b*.

The terminal 23 is different from the terminal 20 in having terminal-side engagement portions 23*a*.

The other constituent elements are the same as in the first embodiment and are given the same reference symbols as in the first embodiment.

The sealing-member-side engagement portions 51*b* are a pair of ribs which are formed on the two respective side surfaces 51*a* of the intermediate portion sealing member 51 so as to extend in the top-bottom direction.

The terminal-side engagement portions 23*a* are a pair of grooves which are formed in the two respective side walls 30*b* of the intermediate portion 30 so as to correspond to the respective sealing-member-side engagement portions 51*b* and to extend in the top-bottom direction.

In the above-configured connection structure for electric wire and terminal 3, the sealing-member-side engagement portions 51*b* are engaged with the respective terminal-side engagement portions 23*a*, whereby the intermediate portion sealing member 51 is positioned and fixed at a prescribed position in the housing portion 31.

The connection structure for electric wire and terminal 3 according to the second embodiment provides the same advantages as the connection structure for electric wire and terminal 1 according to the first embodiment.

(Modification 1)

Next, a first modification of the second embodiment of the invention will be described with reference to FIG. 7.

Figure 7:
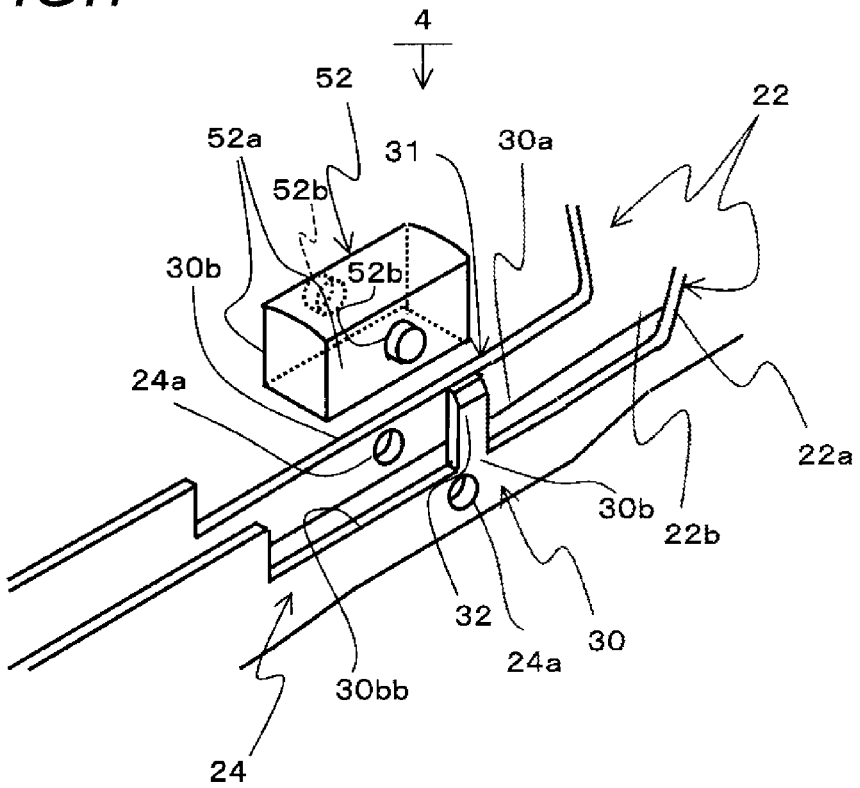
FIG. 7 is an enlarged view of an essential part of a connection structure for an electric wire and a terminal according to a first modification of the second embodiment of the invention.

FIG. 7 is an enlarged view of an essential part of a connection structure for electric wire and terminal 4 according to the first modification of the second embodiment of the invention.

In the connection structure for electric wire and terminal 4 according to the first modification, an intermediate portion sealing member 52 has sealing-member-side engagement portions 52*b* in place of the sealing-member-side engagement portions 51*b* and a terminal 24 has terminal-side engagement portions 24*a* in place of the terminal-side engagement portions 23*a*.

The other constituent elements are the same as in the second embodiment and are given the same reference symbols as in the second embodiment.

The sealing-member-side engagement portions 52*b* are a pair of cylindrical projections which are formed on the two respective side surfaces 52*a* of the intermediate portion sealing member 52 so as to project cylindrically.

The terminal-side engagement portions 24*a* are a pair of circular openings which are formed in the two respective side walls 30*b* of the intermediate portion 30 so as to correspond to the respective sealing-member-side engagement portions 52*b*.

In the above-configured connection structure for electric wire and terminal 4, the sealing-member-side engagement portions 52*b* are engaged with the respective terminal-side engagement portions 24*a*, whereby the intermediate portion sealing member 52 is positioned and fixed at a prescribed position in the housing portion 31.

(Modification 2)

Next, a second modification of the second embodiment of the invention will be described with reference to FIG. 8.

Figure 8:
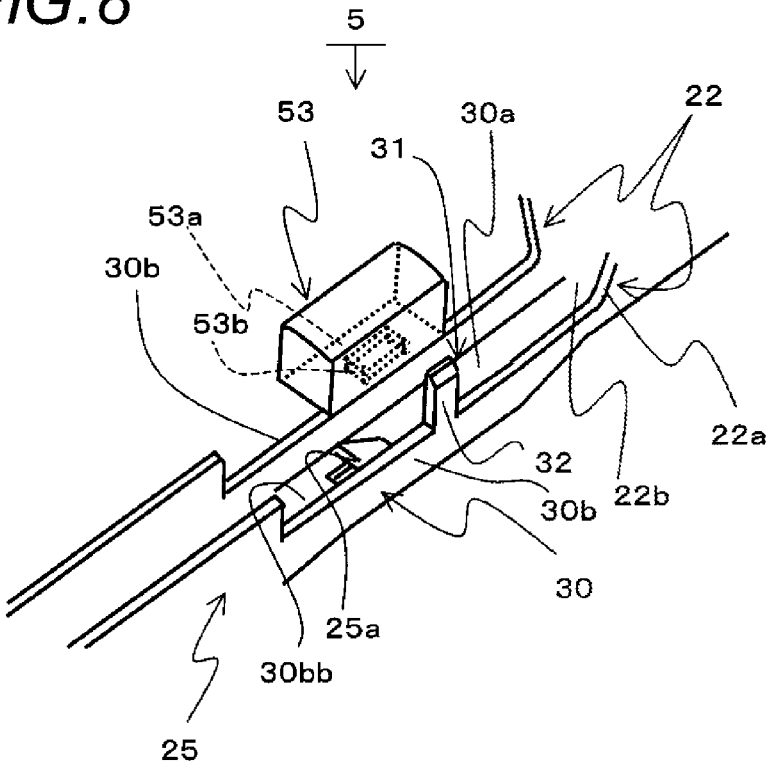
FIG. 8 is an enlarged perspective view of an essential part of a connection structure for an electric wire and a terminal according to a second modification of the second embodiment of the invention.

FIG. 8 is an enlarged perspective view of an essential part of a connection structure for electric wire and terminal 5 according to the second modification of the second embodiment of the invention.

In the connection structure for electric wire and terminal 5 according to the second modification, an intermediate portion sealing member 53 has a sealing-member-side engagement portion 53*b* in place of the sealing-member-side engagement portions 51*b* and a terminal 25 has a terminal-side engagement portion 25*a* in place of the terminal-side engagement portions 23*a*.

The sealing-member-side engagement portion 53*b* is a recess which is formed in the bottom surface 53*a* of the intermediate portion sealing member 53.

The terminal-side engagement portion 25*a* is a lance which is formed on the bottom wall 30*a* of the intermediate portion 30 so as to correspond to the sealing-member-side engagement portion 53*b*.

In the above-configured connection structure for electric wire and terminal 5, the sealing-member-side engagement portion 53*b* is engaged with the terminal-side engagement portion 25*a*, whereby the intermediate portion sealing member 53 is positioned and fixed at a prescribed position in the housing portion 31.

(Modification 3)

Figure 9:
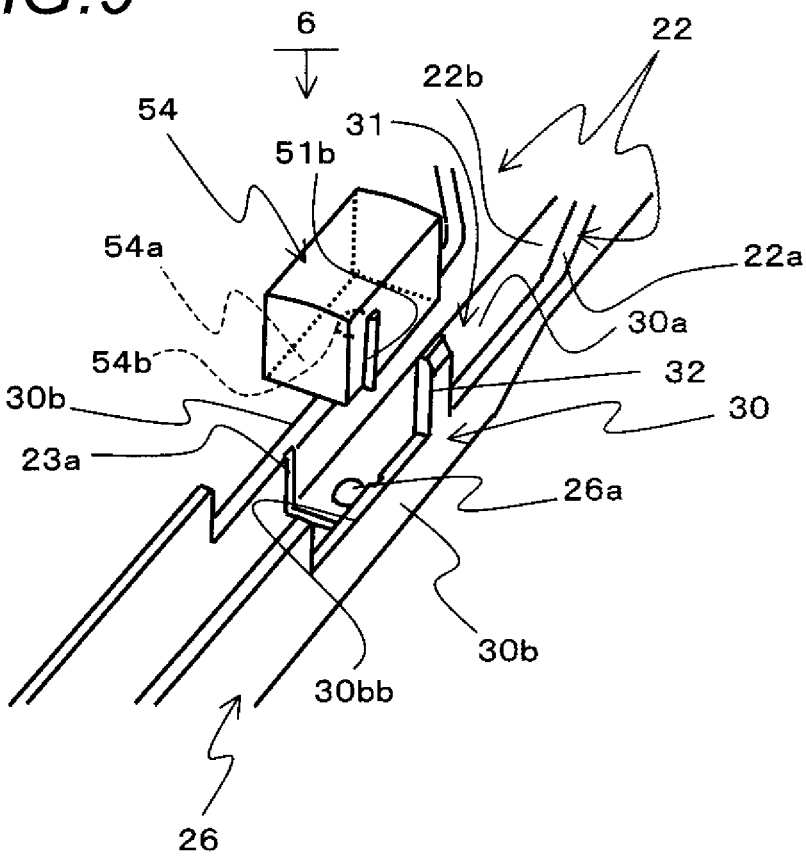
FIG. 9 is an enlarged perspective view of an essential part of a connection structure for an electric wire and a terminal according to a third modification of the second embodiment of the invention.

Next, a third modification of the second embodiment of the invention will be described with reference to FIG. 9. FIG. 9 is an enlarged perspective view of an essential part of a connection structure for electric wire and terminal 6 according to the third modification of the second embodiment of the invention.

In the connection structure for electric wire and terminal 6 according to the third modification, an intermediate portion sealing member 54 has a second sealing-member-side engagement portion 54*b* in addition to a sealing-member-side engagement portion 51*b* and a terminal 26 has a second terminal-side engagement portion 26*a* in addition to a terminal-side engagement portion 23*a*.

The second sealing-member-side engagement portion 54*b* is a hemispherical recess which is formed in the bottom surface 54*a* of the intermediate portion sealing member 54.

The second terminal-side engagement portion 26*a* is a hemispherical projection which is formed on the bottom wall 30*a* of the intermediate portion 30 so as to correspond to the second sealing-member-side engagement portion 54*b*.

In the above-configured connection structure for electric wire and terminal 6, the sealing-member-side engagement portion 51*b* is engaged with the terminal-side engagement portion 23*a* and the second sealing-member-side engagement portion 54*b* is engaged with the second terminal-side engagement portion 26*a*, whereby the intermediate portion sealing member 54 is positioned and fixed at a prescribed position in the housing portion 31.

(Embodiment 3)

Now, a connection structure for electric wire and terminal 7 according to a third embodiment of the invention will be described with reference to FIGS. 10 and 11.

Figure 10:
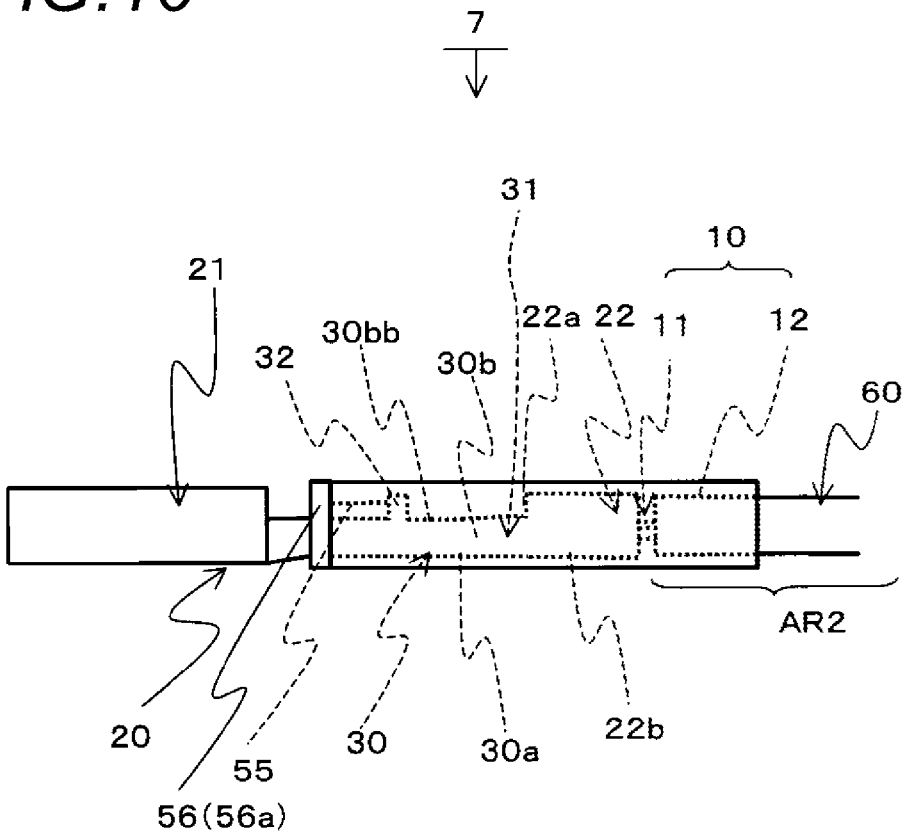
FIG. 10 is a side view of a connection structure for an electric wire and a terminal according to a third embodiment of the invention.

FIG. 10 is a side view of the connection structure for electric wire and terminal 7 according to the third embodiment of the invention. FIG. 11 is a view illustrating a procedure of attachment of the hollow covering member 60 shown in FIG. 10.

An intermediate portion sealing member 55 of the connection structure for electric wire and terminal 7 according to the third embodiment is different from the intermediate portion sealing member 50 used in the first embodiment in having a positioning portion 56.

The other constituent elements are the same as in the first embodiment and are given the same reference symbols as in the first embodiment.

The positioning portion 56 is a portion having a function of positioning the hollow covering member 60. The positioning portion 56 is an end portion 56*a*, opposed to the mating terminal connection portion 21, of the intermediate portion sealing member 55, projects in a flange-like manner so as to conform to the outer periphery, located at the position of the end portion 56*a* of the intermediate portion sealing member 55, of the terminal 20, and is formed integrally with the terminal 20.

Figure 11:
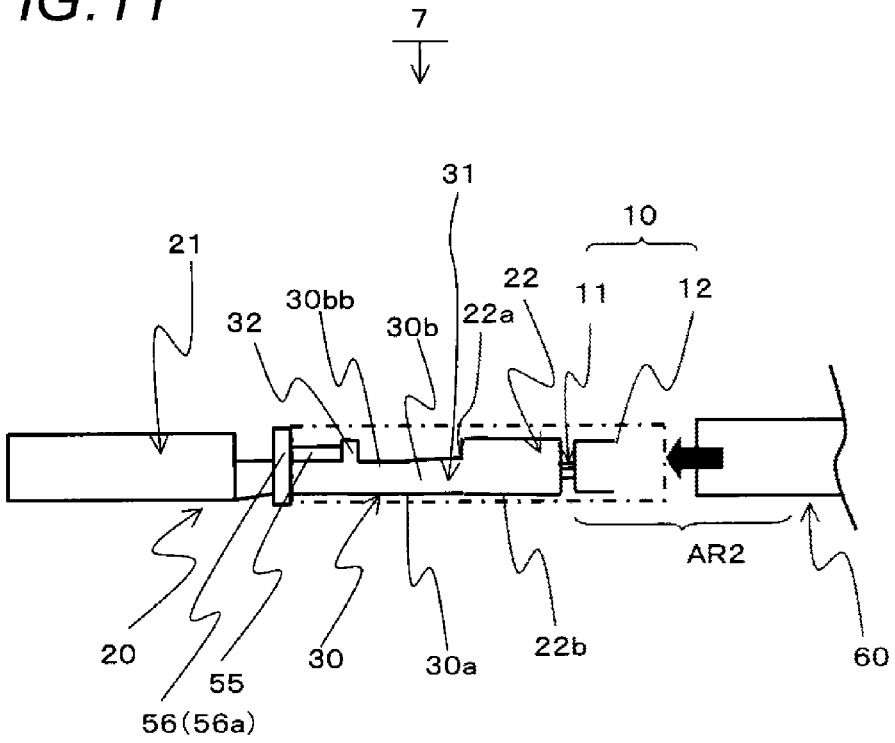
FIG. 11 is a view illustrating a procedure of attachment of a hollow covering member shown in FIG. 10.

In the connection structure for electric wire and terminal 7 according to the third embodiment, when the hollow covering member 60 is attached to the terminal 20, as shown in FIG. 11 the position where one end of the hollow covering member 60 comes into contact with the positioning portion 56 is used as a reference position of attachment of the hollow covering member 60. As a result, the hollow covering member 60 can be disposed accurately at a prescribed position, whereby the waterproof performance can be enhanced.

(Modification)

Next, a modification of the third embodiment of the invention will be described.

Figure 12:
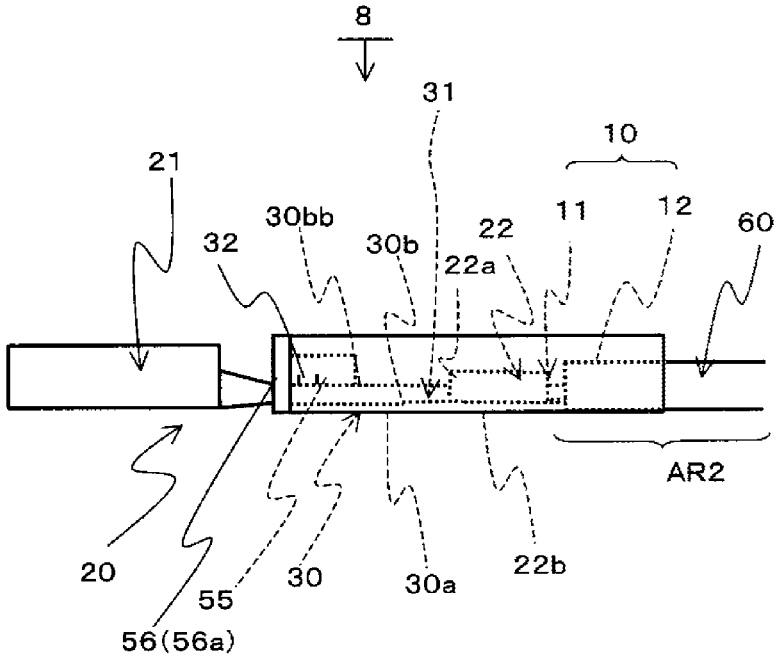
FIG. 12 is a side view of a connection structure for an electric wire and a terminal according to a modification of the third embodiment of the invention.

FIG. 12 is a view of a connection structure for electric wire and terminal 8 according to the modification of the third embodiment of the invention.

In the connection structure for electric wire and terminal 8 according to this modification, as shown in FIG. 12, like the intermediate portion sealing member 50 used in the modification of the first embodiment, an intermediate portion sealing member 55 is molded integrally with the terminal 20 after the projection 32 was bent.

(Embodiment 4)

Next, a connection structure for electric wire and terminal 9 according to a fourth embodiment of the invention will be described with reference to FIGS. 13 and 14.

Figure 13:
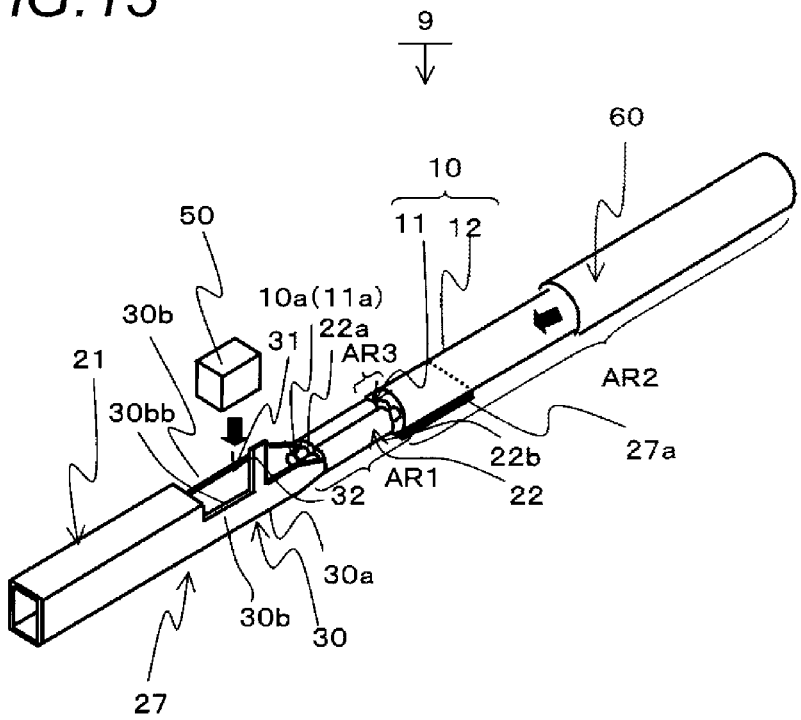
FIG. 13 is an exploded perspective view of a connection structure for an electric wire and a terminal according to a fourth embodiment of the invention.

FIG. 13 is an exploded perspective view of the connection structure for electric wire and terminal 9 according to the fourth embodiment of the invention.

Figure 14:
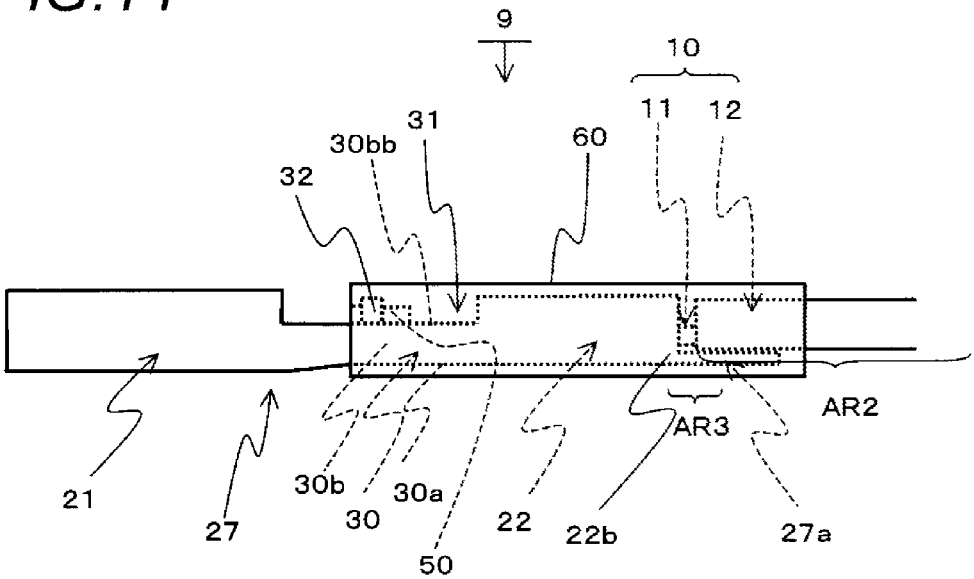
FIG. 14 is a side view of the connection structure for the electric wire and the terminal shown in FIG. 13.

FIG. 14 is a side view of the connection structure for electric wire and terminal 9 shown in FIG. 13.

The connection structure for electric wire and terminal 9 according to the fourth embodiment has a terminal 27 in place of the terminal 20 used in the first embodiment. The terminal 27 is different from the terminal 20 used in the first embodiment in further having a wire support portion 27*a*.

The other constituent elements are the same as in the first embodiment and are given the same reference symbols as in the first embodiment.

The wire support portion 27*a* supports that portion of the conductor 11 which exists in a boundary region AR3 located between the conductor-exposed region AR1 and the insulating covering region AR2. The wire support portion 27*a* is formed as part of a bottom portion 22*b*, extending from an end portion 22*a* of the crimping portion 22 to somewhere in the insulating covering region AR2, of the crimping portion 22.

In the connection structure for electric wire and terminal 9 according to the fourth embodiment, since the wire support portion 27*a* supports, together with the hollow covering member 60, that portion of the conductor 11 which exists in the boundary region AR3 located between the conductor-exposed region AR1 and the insulating covering region AR2, the conductor 11 can be prevented more effectively from being damaged through bending in the boundary region.

In the connection structure for electric wire and terminals 1, 2, 3, 4, 5, 6, 7, 8, and 9 according to the first to fourth embodiments of the invention, each of the intermediate portion sealing members 50, 51, 52, 53, 54, and 55 is approximately shaped like a rectangular parallelepiped, the invention is not limited to such a case. That is, each of the intermediate portion sealing members 50, 51, 52, 53, 54, and 55 may have any of other shapes as long as it can be fitted in the housing portion.

Although the invention made by the inventors have been described in a specific manner using the embodiments of the invention, the invention is not limited to the above-described embodiments and various modifications are possible without departing from the spirit and scope of the invention.

The connection structure for electric wire and terminal according to the invention can provide a connection structure for electric wire and terminal which can prevent entrance of water more reliably and can also prevent corrosion even in the case of using a hollow covering member.

What is claimed is:

1. A connection structure for an electric wire and a terminal, wherein the terminal includes a mating terminal connection portion configured to be connected to a mating terminal and a crimping portion which crimps to a conductor of an electric wire, in the electric wire, an insulating covering member is removed in an end portion and the conductor is thereby exposed to the outside, and the electric wire is connected to the terminal by the crimping portion, the connection structure comprising:

an intermediate portion that is provided between the mating terminal connection portion and the crimping portion and has a housing portion which houses a terminating section of the end portion, exposed to the outside, of the conductor;

an intermediate portion sealing member that is fitted in the housing portion; and a hollow covering member that extends in an extending direction of the electric wire and covers a portion from the intermediate portion to an insulating covering region in which the electric wire is covered with the insulating covering member, wherein the intermediate portion sealing member has a first engagement portion and the intermediate portion of the terminal has a second engagement portion;

wherein the intermediate portion sealing member is positioned to the intermediate portion by engagement between the first engagement portion and the second engagement portion; and wherein the intermediate portion sealing member has a positioning portion for positioning the hollow covering member, the positioning portion being an end portion, opposed to the mating terminal connection portion, of the intermediate portion sealing member, projecting in a flange-like manner so as to conform to an outer periphery, located at a position of the end portion, of the terminal, and being formed integrally with the terminal.

2. The connection structure for the electric wire and the terminal according to claim 1, wherein: the intermediate portion sealing member has a sealing-member-side engagement portion;

wherein the intermediate portion of the terminal has a terminal-side engagement portion; and wherein the intermediate portion sealing member is fixed in the housing portion by engagement between the sealing-member-side engagement portion and the terminal-side engagement portion.

3. The connection structure for the electric wire and the terminal according to claim 1, wherein the housing portion has a bottom wall, a pair of side walls which are erected from both edges of the bottom wall, and a projection which projects from a top end of one of the pair of side walls; and wherein the projection crimps to the intermediate portion sealing member.

4. The connection structure for the electric wire and the terminal according to claim 1, wherein the terminal has a wire support portion which is part of a bottom portion of the crimping portion, extending from an end portion of the crimping portion to the insulating covering region.

5. The connection structure for the electric wire and the terminal according to claim 1, wherein the terminal has a wire support portion which is part of a bottom portion of the crimping portion, extending from an end portion of the crimping portion to somewhere in the insulating covering region.

6. The connection structure for the electric wire and the terminal according to claim 1, wherein the intermediate portion connects the mating terminal connection portion and the crimping portion.

7. The connection structure for the electric wire and the terminal according to claim 1, wherein the intermediate portion sealing member is formed of an elastic material including at least one of a resin and a rubber.

8. The connection structure for the electric wire and the terminal according to claim 1, wherein the intermediate portion sealing member is configured to simplify an exterior shape of the intermediate portion to facilitate close contact with the hollow covering member.

9. The connection structure for the electric wire and the terminal according to claim 1, wherein the intermediate portion sealing member is integrally molded with the terminal.

10. The connection structure for the electric wire and the terminal according to claim 9, wherein the housing portion has a bottom wall, a pair of side walls which are erected from both edges of the bottom wall, and a projection which projects from a top end of one of the pair of side walls; and wherein the projection crimps to the intermediate portion sealing member.

11. The connection structure for the electric wire and the terminal according to claim 9, wherein the terminal has a wire support portion which is part of a bottom portion of the crimping portion, extending from an end portion of the crimping portion to the insulating covering region.

12. The connection structure for the electric wire and the terminal according to claim 9, wherein the housing portion has a bottom wall, a pair of side walls which are erected from both edges of the bottom wall, and a projection which projects from a top end of one of the pair of side walls; and wherein the intermediate portion sealing member is integrally molded with the terminal in a state that the projection is bent in the housing portion.

13. The connection structure for the electric wire and the terminal according to claim 12, wherein the terminal has a wire support portion which is part of a bottom portion of the crimping portion, extending from an end portion to somewhere in the insulating covering region.

14. A connection structure for an electric wire and a terminal, wherein the terminal includes a mating terminal connection portion configured to be connected to a mating terminal and a crimping portion which crimps to a conductor of an electric wire, in the electric wire, an insulating covering member is removed in an end portion and the conductor is thereby exposed to the outside, and the electric wire is connected to the terminal by the crimping portion, the connection structure comprising:

an intermediate portion that is provided between the mating terminal connection portion and the crimping portion and has a housing portion which houses a terminating section of the end portion, exposed to the outside, of the conductor;

an intermediate portion sealing member that is fitted in the housing portion; and a hollow covering member that extends in an extending direction of the electric wire and covers a portion from the intermediate portion to an insulating covering region in which the electric wire is covered with the insulating covering member, wherein the intermediate portion sealing member has a first engagement portion and the intermediate portion of the terminal has a second engagement portion;

wherein the intermediate portion sealing member is positioned to the intermediate portion by engagement between the first engagement portion and the second engagement portion; and, wherein the intermediate portion sealing member is shaped as a rectangular parallelepiped.

15. A connection structure for an electric wire and a terminal, wherein the terminal includes a mating terminal connection portion configured to be connected to a mating terminal and a crimping portion which crimps to a conductor of an electric wire, in the electric wire, an insulating covering member is removed in an end portion and the conductor is thereby exposed to the outside, and the electric wire is connected to the terminal by the crimping portion, the connection structure comprising:

an intermediate portion that is provided between the mating terminal connection portion and the crimping portion and has a housing portion which houses a terminating section of the end portion, exposed to the outside, of the conductor;

an intermediate portion sealing member that is fitted in the housing portion; and a hollow covering member that extends in an extending direction of the electric wire and covers a portion from the intermediate portion to an insulating covering region in which the electric wire is covered with the insulating covering member, wherein the intermediate portion sealing member has a first engagement portion and the intermediate portion of the terminal has a second engagement portion;

wherein the intermediate portion sealing member is positioned to the intermediate portion by engagement between the first engagement portion and the second engagement portion; and, wherein all exterior surfaces of the intermediate portion sealing member are planar.

* * * * *